US010935920B2

(12) United States Patent
Sato

(10) Patent No.: US 10,935,920 B2
(45) Date of Patent: Mar. 2, 2021

(54) IMAGE FORMING APPARATUS WITH A GRIP

(71) Applicant: CANON KABUSHIKI KAISHA, Tokyo (JP)

(72) Inventor: Koki Sato, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/791,036

(22) Filed: Feb. 14, 2020

(65) Prior Publication Data

US 2020/0264552 A1 Aug. 20, 2020

(30) Foreign Application Priority Data

Feb. 15, 2019 (JP) ..... JP2019-025102

(51) Int. Cl.
*G03G 21/16* (2006.01)
*G03G 15/01* (2006.01)

(52) U.S. Cl.
CPC ..... *G03G 21/1604* (2013.01); *G03G 15/0142* (2013.01); *G03G 2215/00004* (2013.01); *G03G 2221/1681* (2013.01); *G03G 2221/1684* (2013.01)

(58) Field of Classification Search
CPC ... G03G 2221/1681; G03G 2221/1684; G03G 2221/1846; G03G 15/0142; G03G 15/6505; G03G 21/1604; G03G 21/1638; G03G 21/1846; G03G 2215/00004; B41J 29/13; B41J 29/52
USPC ..... 399/110
See application file for complete search history.

(56) References Cited

U.S. PATENT DOCUMENTS 6,834,172 B2 * 12/2004 Tomita ..... G03G 15/00 16/429
7,106,990 B2 * 9/2006 Murano ..... G03G 21/1633 399/107
7,664,428 B2 * 2/2010 Kei ..... G03G 21/1853 399/110
8,792,805 B2 * 7/2014 Takayama ..... G03G 21/1853 399/111
9,081,357 B2 * 7/2015 Park ..... G03G 21/1661
2007/0071494 A1 * 3/2007 Igarashi ..... G03G 21/1661 399/110

FOREIGN PATENT DOCUMENTS

JP 2007-106099 A 4/2007

* cited by examiner

*Primary Examiner* — Arlene Heredia
(74) *Attorney, Agent, or Firm* — Venable LLP

(57) ABSTRACT

An image forming apparatus includes a main assembly, a grip, a first guiding member, and a second guiding member. The grip is linearly movable between a first position accommodated inside the main assembly and a second position projecting from the main assembly. The grip has a projection of resin material projecting downwardly from a lower surface of the grip. The first guiding member is provided above the grip to guide the movement of the grip, and the second guiding member is provided below the grip and configured to guide the movement of the grip together with the first guiding member. The second guiding member is provided with an engaging portion projecting from an upper surface of the second guiding member and capable of engaging with the projection to restrict movement of the grip toward the second position when the grip is in the first position.

17 Claims, 7 Drawing Sheets

IMAGE FORMING APPARATUS WITH A GRIP

FIELD OF THE INVENTION AND RELATED ART

The present invention relates to an electrophotographic coping machine, an electrophotographic printer (for example, laser beam printer and LED printer, for example), an inkjet printer, and the like image forming apparatuses.

There have been known image forming apparatuses, the main assembly of which is provided with a grip for improving the apparatuses in operational efficiency, that is, making them easier to carry. For example, there is disclosed in Japanese Laid-open Patent Application No. 2007-106099, an image forming apparatus structured so that its grip is movable between a position (innermost position) in which the grip remains, in the main assembly of the apparatus, and a position (outermost position), into which the grip is pulled out of the innermost position, and in which the grip remains protrusive from the main assembly of the apparatus.

However, in the case of the image forming apparatus disclosed in Japanese Laid-open Patent Application No. 2007-106099, the grip portion is not provided with a stopper or the like. Therefore, it is possible that if the image forming apparatus is subjected to an impact, the grip in the innermost position will accidentally move into an outside position. As the grip moves into an outside position, in which it remains outwardly protrusive, it is likely to become an annoyance to a passerby, or a person who is working in the adjacencies of the apparatus.

By the way, in Japanese Laid-open Patent Application No. 2007-106099, an image forming apparatus, the grip of which is provided with a locking member for keeping the grip locked in the innermost position, is disclosed. In the case of this structural arrangement, the locking member has to be fixed to the main assembly of the apparatus with screws to keep the grip in its innermost position. Therefore, in case where the locking member is not fixed to the main assembly of the apparatus, for example, immediately before or after the grip is used, it is possible that the above described problem will occur.

The present invention was made in consideration of the above described situation. Thus, the primary object of the present invention is to provide an image forming apparatus structured so that its grip does not accidentally move from its innermost position to an outside position.

SUMMARY OF THE INVENTION

According to an aspect of the present invention, there is provided an image forming apparatus including a main assembly, a grip portion, a first guiding member, and a second guiding member. The grip portion is linearly movable between a first position accommodated inside the main assembly and a second position projecting from the main assembly. The grip portion is provided with a projection of resin material projecting downwardly from a lower surface of the grip portion. The first guiding member is provided above the grip portion and configured to guide the movement of the grip portion. The second guiding member is provided below said grip portion and configured to guide the movement of the grip portion together with the first guiding member. The second guiding member is provided with an engaging portion projecting from an upper surface of the second guiding member and capable of engaging with the projection to restrict movement of the grip portion toward the second position when the grip portion is in the first position.

Further features of the present invention will become apparent from the following description of exemplary embodiments with reference to the attached drawings.

Figure 1:
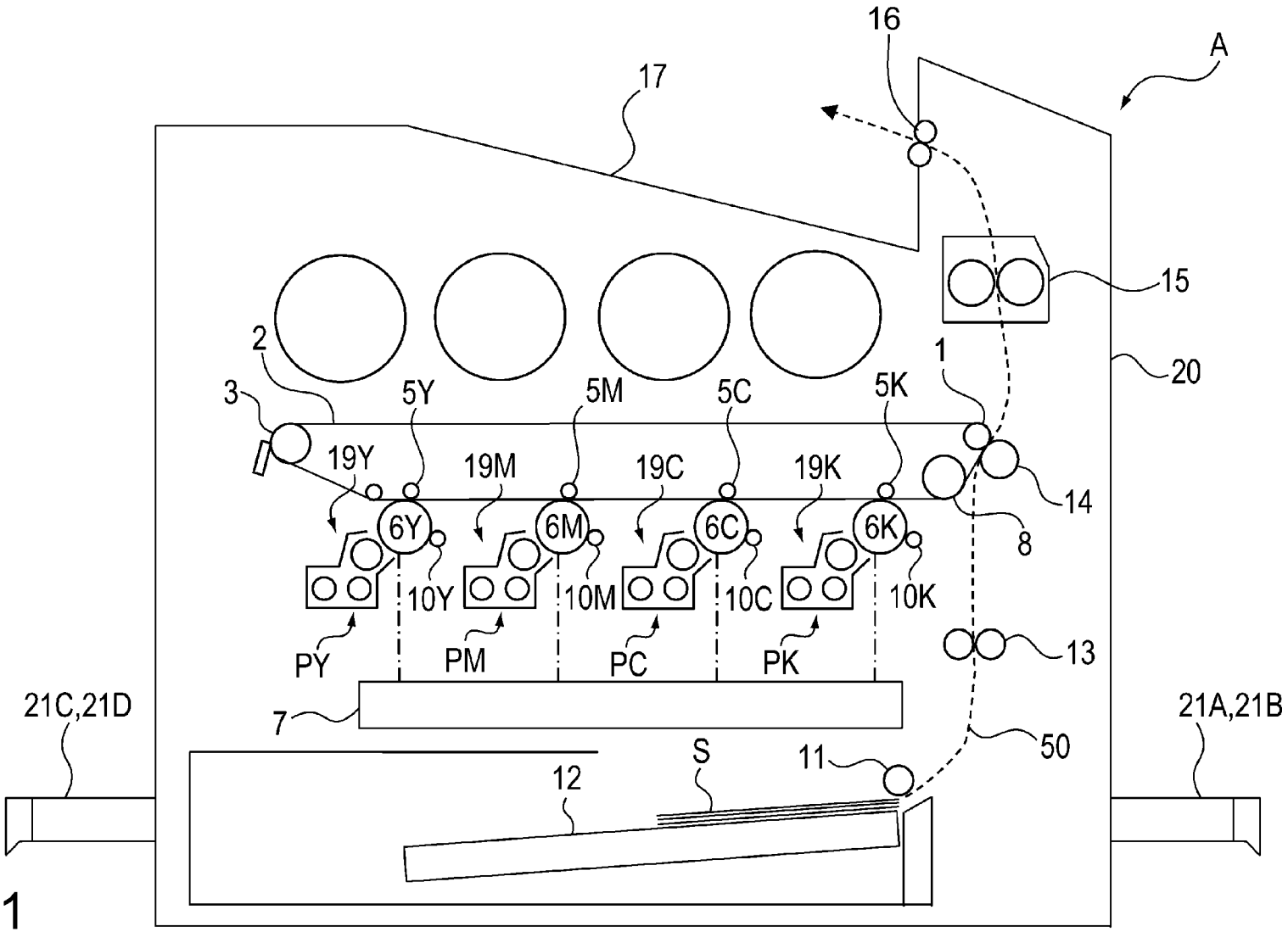
FIG. 1 is a schematic sectional view of the image forming apparatus which is in accordance with the present invention.
Figure 2:
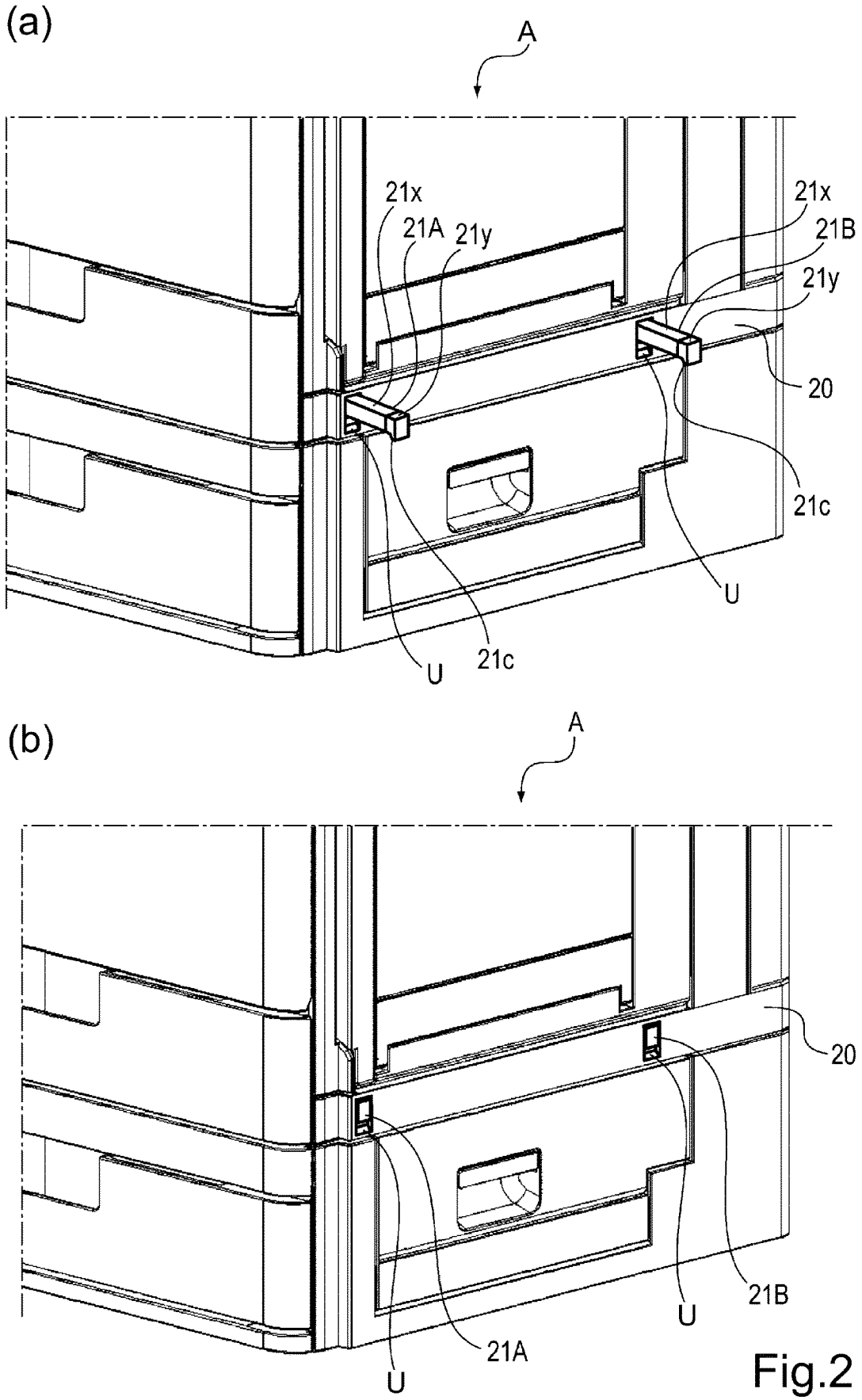

Parts (a) and (b) of FIG. 2 are perspective views of the adjacencies of one of the grips of the image forming apparatus shown in FIG. 1.

Figure 3:
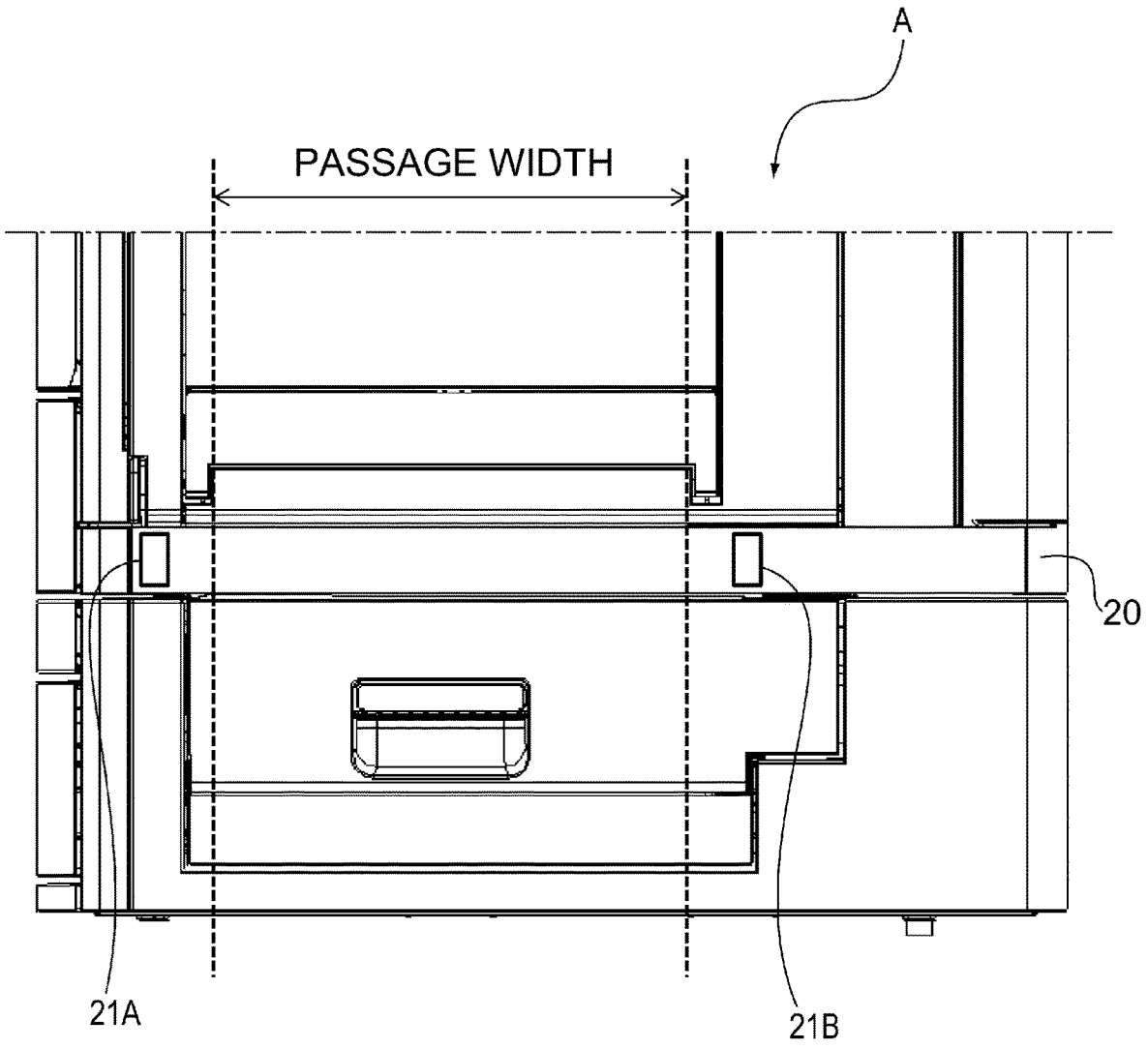

FIG. 3 is a side view of the image forming apparatus shown in FIG. 1.

Figure 4:
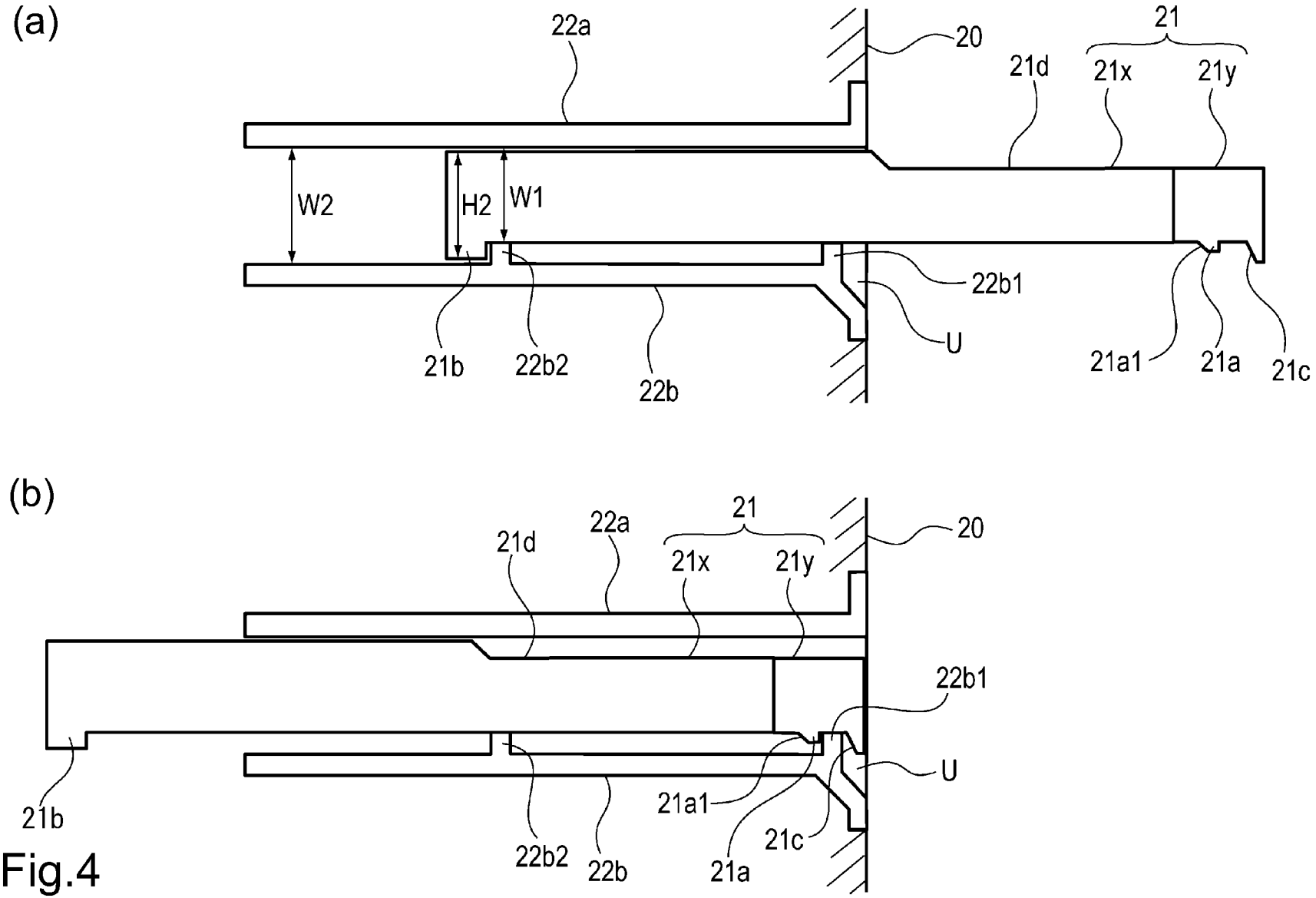

Parts (a) and (b) of FIG. 4 are sectional views of a combination of the image forming apparatus and its grip.

Figure 5:
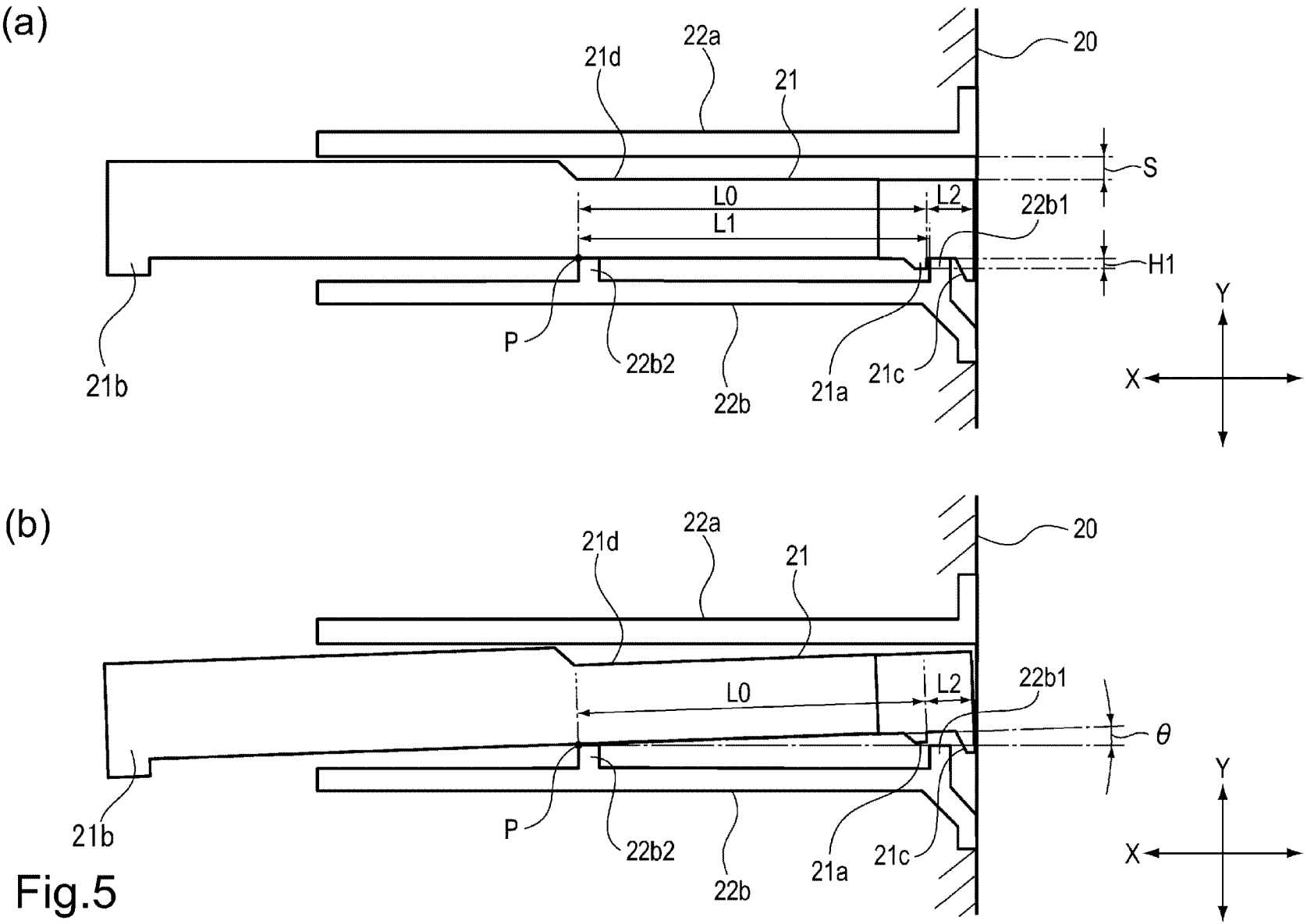

Parts (a) and (b) of FIG. 5 are views for showing the relationship between one of the grips, and the corresponding guide rail, in terms of their measurements.

Figure 6:
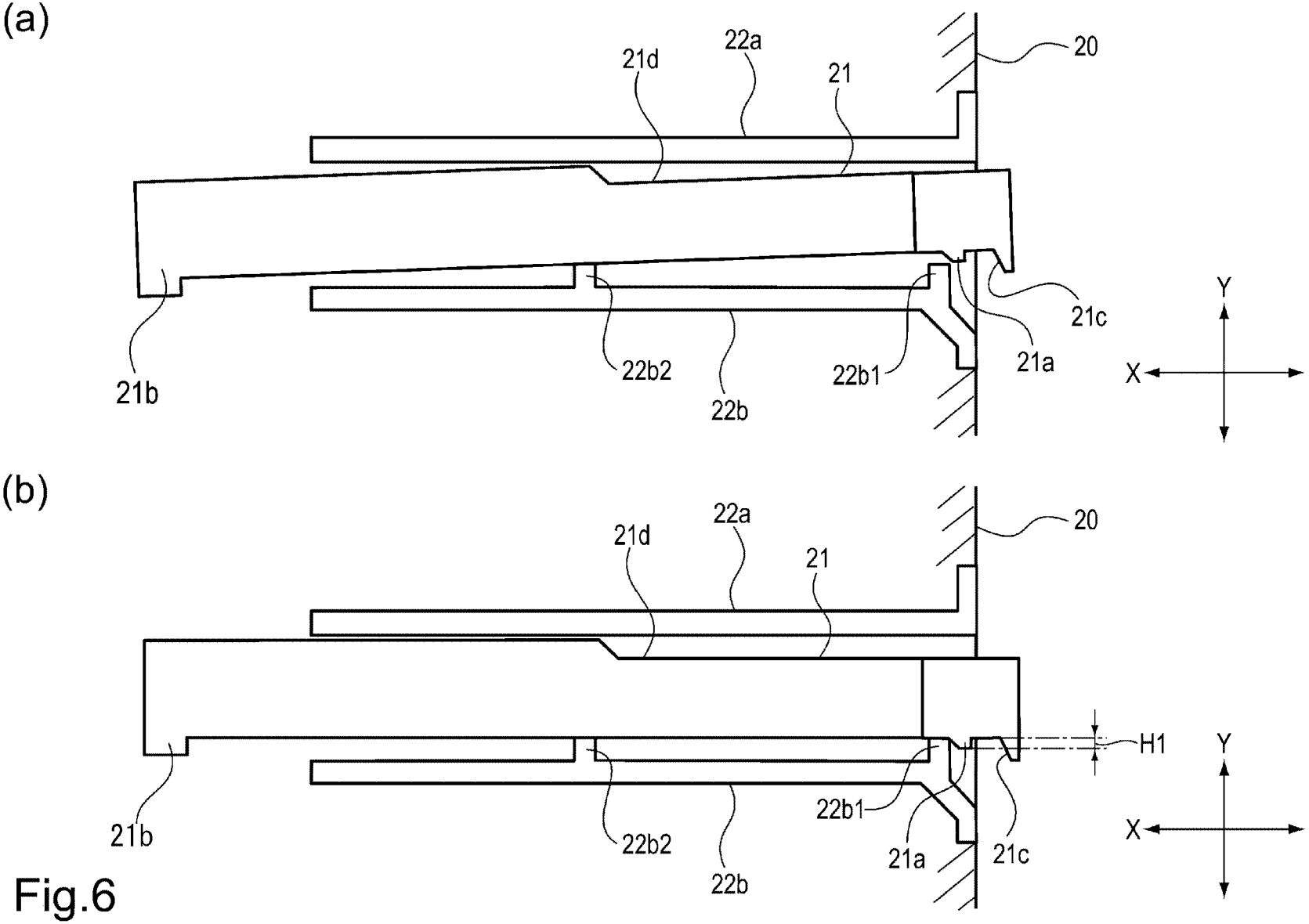

Parts (a) and (b) of FIG. 6 are views showing the relationship between one of the grips, and the corresponding guide rail, in terms of their measurements.

Figure 7:
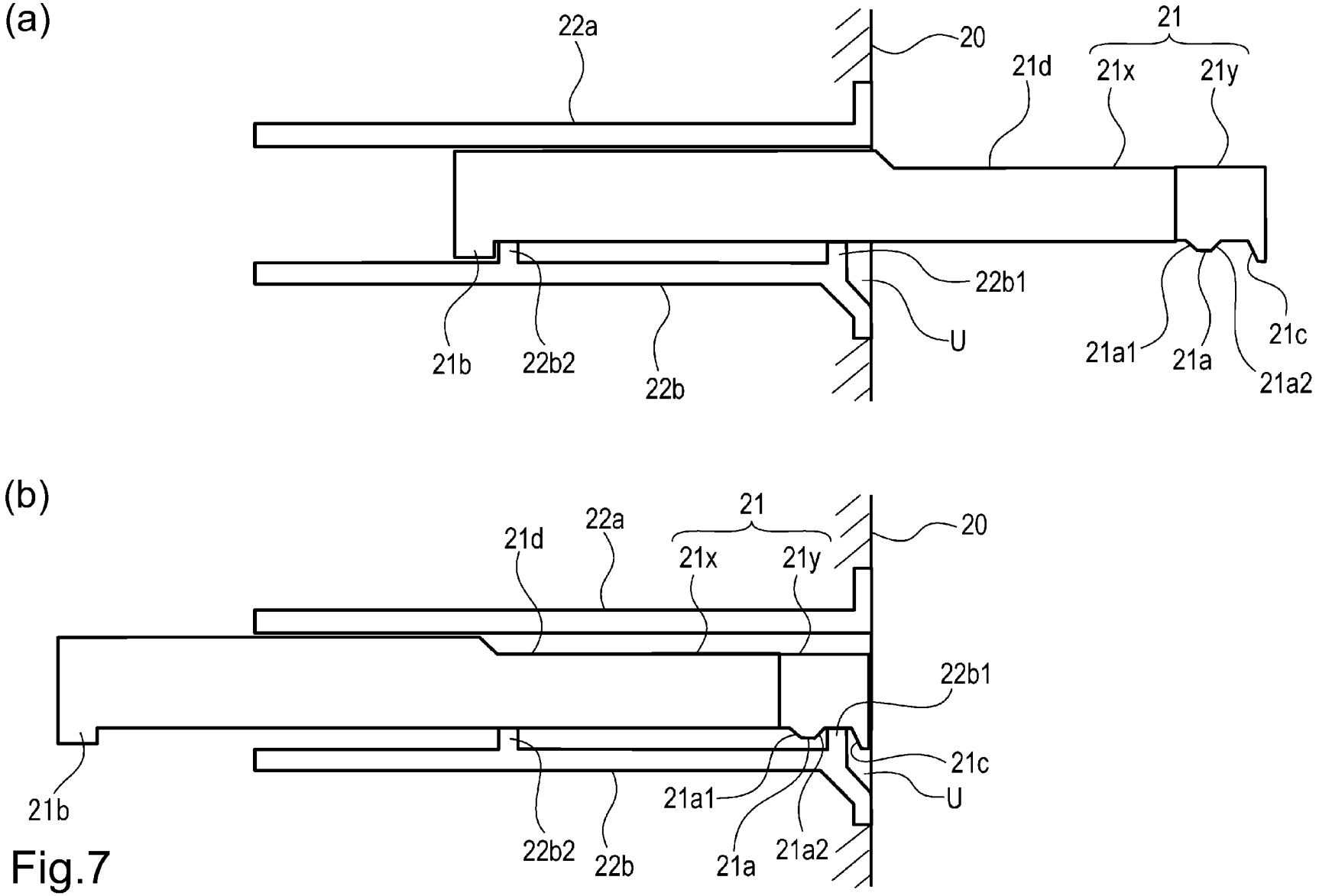

Parts (a) and (b) FIG. 7 are sectional views of a combination of the main assembly of the image forming apparatus, and one of the grips of the main assembly.

DESCRIPTION OF THE EMBODIMENTS

Embodiment 1

<Image Forming Apparatus>

Hereinafter, the overall structure of the image forming apparatus in the first embodiment of the present invention, and the image forming operation of the apparatus, are described with reference to appended drawings. By the way, the measurements, materials, and shapes of the structural components of this apparatus, and the positional relationship among the components, which are going to be described thereafter, are not intended to limit the present invention in scope, unless specifically noted.

FIG. 1 is a schematic sectional view of the image forming apparatus A. The image forming apparatus A has an image forming portion which forms a toner image by transferring a toner image onto a sheet of recording medium, a sheet conveying portion which conveys a sheet of recording medium toward the image forming portion, and a fixing portion which fixes the toner images to the sheet.

The image forming portion employs process cartridges P (PY, PM, PC and PK). It has primary transfer rollers 5 (5Y, 5M, 5C and 5K), and a laser scanner unit 7. It has also an intermediary transfer belt 2, a secondary transfer roller 14, a belt-backing roller 1 which opposes the secondary transfer roller 14, a tension roller 3, and an idler roller 8.

Each process cartridge P has a photosensitive drum 6 (6Y, 6M, 6C or 6K), a charge roller 10 (10Y, 10M, 10C or 10K), and a developing apparatus 19 (19Y, 19M, 19C or 19K).

Next, the image forming operation is described. As an unshown controlling portion of the image forming apparatus A receives an image formation job signal, the sheets S of recording medium stored in layers in a sheet storage portion 12 are sent one by one to the secondary transferring portion formed by the secondary transfer roller 14 and belt-backing roller 1.

Meanwhile, in the image forming portion, first, the peripheral surface of the photosensitive drum 6 is uniformly charged by the charge roller 10. Then, the laser scanner unit 7 forms an electrostatic latent image on the peripheral surface of the photosensitive drum 6 by projecting a beam of laser light upon the peripheral surface of the photosensitive drum 6, while modulating the beam with the image data transmitted from an unshown external device, or the like.

Thereafter, toner is adhered to the electrostatic latent image on the peripheral surface of the photosensitive drum 6 by the developing apparatus 19. As a result, a visible image is effected on the peripheral surface of the photosensitive drum 6 (this image is referred to as toner image, hereafter). After the formation of the toner image on the peripheral surface of the photosensitive drum 6, the toner image is transferred onto the intermediary transfer belt 2 by the bias applied to the primary transfer roller 5; the four toner images, which are different in color, are transferred in layers onto the surface of the intermediary transfer belt 2. As a result, a full-color toner image is formed on the intermediary transfer belt 2.

Thereafter, the full-color toner image is sent to the secondary transferring portion by the circular rotation of the intermediary transfer belt 2. In the secondary transferring portion, bias is applied to the secondary transfer roller 14. Consequently, the toner image on the intermediary transfer belt 2 is transferred onto a sheet S of recording medium.

After the transfer of the toner image onto the sheet S, the sheet S is sent to the fixing apparatus, by which the sheet S and the toner image thereon are heated while being pressed. Consequently, the toner image becomes fixed to the sheet S. Then, the sheet S is discharged into a delivery portion 17 by a pair of discharge rollers 16.

By the way, the image forming apparatus A in this embodiment is not provided with an image reading apparatus for reading an original. However, the present invention is also applicable to a combination of the image forming apparatus A shown in FIG. 1, and an image reading apparatus placed on the image forming apparatus A.

<Grip>

The image forming apparatus A is provided with a pair of grips 21A and 21B, which can be made to protrude from the right wall of the main assembly of the image forming apparatus (which hereafter will be referred to as main assembly 20), for a user to grab to lift or carry the apparatus. The apparatus main assembly 20 is a frame, which internally holds the image forming portion, sheet conveying portion which comprises a feed roller 11, a conveyance roller 13, etc. and internally supports them. It is a metallic frame, for example, for supporting the image forming portion, sheet conveying portion, and fixing apparatus 15. It may include an outer frame, which is formed of a resinous substance and is attached to the metallic frame. The outer frame is for covering the image forming portion, sheet conveying portion, and fixing apparatus 15. Further, the image forming apparatus A is provided with four grips 21A, 21B, 21C and 21D, which can be made to outwardly protrude from the side walls of the apparatus main assembly 20. The grips 21A and 21B can be made outwardly protrusive from the right side wall, and the grips 21C and 21D can be made outwardly protrusive from the lift side wall, so that when the image forming apparatus A needs to be moved two or more operators can grasp the grips from the left and right sides of the apparatus main assembly 20 to lift the apparatus. By the way, the grips 21A, 21B, 21C and 21D are the same in function, and also, is the same in structure. Therefore, the present invention is described with reference to only the grips 21A and 21B.

FIG. 2 is a perspective view of the adjacencies of the grips 21. More specifically, part (a) of FIG. 2 shows the state of the grips 21 and their adjacencies, when the grips 21 are in their outermost position, and part (b) of FIG. 2 shows the state of the grips 21 and their adjacencies when the grips 21 are in the inner most position. FIG. 3 is a side view of the image forming apparatus A as seen from the right side of the apparatus. By the way, here, the "right side of the image forming apparatus A" means the right side of the apparatus, when a user is standing in front of the control portion (unshown) of the image forming apparatus A, which is to be used by a user to set the image forming apparatus A for image formation.

Referring to FIG. 2, the image forming apparatus A is structured so that each grip 21 is linearly and roughly horizontally movable between its innermost position (first position) in the apparatus main assembly 20, and outermost position (second position), in which it is outwardly protrusive from the apparatus main assembly 20. By the way, in this embodiment, if the angle between the direction in which the grips 21A and 21B move, and the horizontal direction, is no more than ±3°, it is said that the moving direction of the grips 21A and 21B is roughly horizontal. In terms of the top-bottom direction (vertical direction) of FIG. 3, the grips 21A and 21B are positioned at the same height, making it easier for operators to balance the image forming apparatus A when the operators carry the image forming apparatus A by lifting the image forming apparatus A by grasping the grips 21A and 21B.

When the grip 21 is in its outermost position, users can lift the image forming apparatus by grasping the grips 21. When users do not intend to use the grips 21, the users can move the grips 21 into the innermost position to prevent the grips 21 from protruding from the apparatus main assembly 20. When the grips 21 are in the innermost position, they do not interfere with users while the users are moving around the apparatus main assembly 20. When the grips 21 are in their innermost position, they are unlikely to interfere with the maintenance operation, such as the removal of jammed sheets of recording medium by the user.

Further, in terms of the direction in which the grip 21 is moved from the innermost position to the outside position, the upstream portion of the grip 21 is a metallic portion 21*x* formed steel plate or the like. As for the downstream side, it is a resinous portion 21*y* formed of ABS or the like.

Each grip 21 has a gripping portion 21*c* which is for a user to grasp the grip 21. The gripping portion 21*c* is a portion of the grip 21, which is downwardly protrusive from the bottom surface of the outward end portion of the grip 21. Further, the apparatus main assembly 20 is provided with a space U, into which the gripping portion 21*c* is retractable. By the way, the shape for the gripping portion 21*c* is not limited to the one in this embodiment. That is, any shape will do as long as the shape is such that the gripping portion of the grip 21 can be hooked by a finger. It may be protrusive, recessive, or in the form of a ring.

Referring to FIG. 3, the grip 21 is positioned so that as the image forming apparatus A is seen from the horizontal direction, the grip 21 does not overlap with the sheet passage 50, through which sheets S of recording medium are conveyed. The image forming apparatus A in this embodiment is capable of forming an image on a sheet S of recording medium, which is A3 in size. Therefore, the width of the sheet passage 50, in terms of the horizontal direction, is 320 mm. Further, the grip 21A is positioned on the front side of the sheet passage 50 in the apparatus main assembly 20, whereas the grip 21B is positioned on the rear side of the sheet passage 50 in the apparatus main assembly 20. That is, the grips 21A and 21B are positioned so that they sandwich the sheet passage 50 in terms of the front-rear direction. Further, the distance between the grip 21B side edge of the space U into which the grip 21A retracts), and the grip 21A side edge of the space U into which the grip 21B retracts, is 450 mm. That is, in terms of the horizontal direction, the distance between the grip 21A and grip 21B is greater than the width of the sheet passage 50.

The grips 21A and 21B in this embodiment can be retracted into the apparatus main assembly 20 by being moved in the horizontal direction. Therefore, as the image forming apparatus A is seen from the front side of the apparatus main assembly 20, the retracted grip 21 and grip 21B overlap with the sheet passage 50. If the distance between the grip 21A and grip 21B, in terms of the horizontal direction, is made less than the width of the sheet passage 50, the grips 21A and 21B interfere with the conveyance of a sheet S of recording medium. In this embodiment, therefore, the grips 21A and 21B are attached to the apparatus main assembly 20 in such a manner that the distance between the grips 21 in terms of the horizontal direction is greater than the width of the sheet passage 50. Therefore, it is possible to prevent the issue that when the grips 21 are in their innermost position, they interfere with the sheet conveyance. By the way, an image forming apparatus which is capable of forming an image on a sheet S of recording medium, which is A4 in size, has also to be structured so that the distance between the grips 21A and 21B is greater than the width of the sheet passage 50.

Regarding the positioning of the grips 21A, 21B, 21C and 21D in terms of the vertical direction, from the standpoint of keeping the image forming apparatus A stable in attitude when lifting the apparatus, the grips are desired to be positioned higher than the center of gravity of the image forming apparatus A. That is, in terms of the vertical direction, the grips 21A, 21B, 21C and 21D are desired to be positioned so that their positions are the same as, or higher than, the position of the center of gravity of the apparatus main assembly 20. However, the positioning of other components of the image forming apparatus A than the grips 21 has to be taken into consideration. Therefore, it is not mandatory that they are to be idealistically positioned. All that is necessary is that in terms of the vertical direction, they are positioned so that they can be grasped at least by hand. Hereafter, the grips 21A, 21B, 21C and 21D are described further in detail about their structure. However, since they are the same in structure, they are described as grips 21.

<Guide Rail>

Next, a guide rail 22 which guides the movement of the grip 21 is described about it structure.

FIG. 4 is a sectional view of a combination of one of the grips 21, and the portions of the apparatus main assembly 20, which are adjacent to the grip 21. More specifically, part (a) of FIG. 4 shows the state of the combination when the grip 21 is in its outermost position, and part (b) of FIG. 4 shows the combination when the combination is in its innermost position.

Referring to FIG. 4, within the apparatus main assembly 20, a pair of guide rails 22, more specifically, a guide rail 22*a* (first guiding member) and a guiding rail 22*b* (second guiding member) are provided. The guide rail 22*a* is positioned on the top side of the corresponding grip 21, whereas the guide rail 22*b* is positioned on the bottom side of the corresponding grip 21. These guide rails 22 guide the grip 21 when the grip 21 is moved between the outermost position and innermost position. The apparatus main assembly 20 includes the aforementioned metallic frame and resinous outer cover. The metallic frame comprises metallic plates, beams, and stays. It is to the metallic frame that a circuit board, and a process unit for forming images, are attached. As for the outer cover, it is attached to the metallic cover, or one of the other outer covers attached to the metallic cover, in a manner to cover the metallic frame. As the material for the metallic frame, steel is used, for example. It is to this metallic frame that the guide rails 22 are fixed. The guide rails 22 are formed of a metallic substance. For example, the guide rails 22 are formed of steel plate, which is the same as the material for the frame.

Each guide rail 22 is provided with a pair of protrusion 22*b*1 and 22*b*2, which are upwardly protrusive from the top surface of the guide rail 22. As the grip 21 is moved into the innermost position, the resinous protrusion 21*a* of grip 21, which is downwardly protrusive from the bottom surface of the resinous portion 21*y* of the grip 21, comes into contact with the protrusion 22*b*1 of the guide rail 22. That is, when the grip 21 is in the innermost position, the protrusion 21*a* of the grip 21 remains in contact with the protrusion 22*b*1 of the rail 22.

As the protrusion 21*a* of the grip 21 remains in contact with the protrusion 22*b*1 of the guide rail 22, the movement of the grip 21 from the innermost position to the outermost position is regulated. Therefore, even if the image forming apparatus A is subjected to an impact, it is possible to prevent the problem that the grip 21 accidentally moves out of the apparatus main assembly 20 from the innermost position.

By the way, even if the image forming apparatus A is structured so that the protrusion 21*a* of the grip 21 is protrusive from the top surface of the grip 21, and the protrusion 22*b*1 of the guide rail 22 is protrusive from the bottom surface of the guide rail 22*a*, it is possible to prevent the problem that the grip 21 accidentally moves from the innermost position to the outermost position. However, the grip 21 is held to the guide rail 22 by gravity. Therefore, it is preferable to structure the image forming apparatus A so that the protrusion 21*a* is protrusive from the bottom surface of the grip 21, and engages with the protrusion 22*b*1 of the guide rail 22, which is upwardly protrusive from the top surface of the guide rail 22, because such a structural arrangement is superior from the standpoint of assuring the two protrusions remain engaged with each other.

If an operator wants to move the grip 21 from its innermost position to its outermost position, the operator is to move the grip 21 toward the outermost position while holding the grip 21 upward. As the grip 21 is moved in the above described manner, the protrusion 21*a* of the grip 21 slides over the protrusion 22*b*1 of the guide rail 22, being thereby disengaged from the protrusion 22*b*1 of the guide rail 22, and therefore, allowing the grip 21 to be moved from the innermost position to the outermost position.

The top surface of the grip 21 is provided with a recessed portion 21*d*, which extends from a preset point of the grip 21 to the downstream edge in terms of the direction in which the grip 21 is moved from the innermost position to the outermost position. By the way, the recessed portion 21*d* may be referred to as a narrowed portion.

Since the grip 21 is provided with the recessed portion 21*d*, it is possible to lift the grip 21 without causing the top portion of the grip 21 to interfere with the guide rail 22*a*. Further, structuring the image forming apparatus A so that the upstream portion the grip 21 relative to the recessed portion 21*d* of the top surface of the grip 21 is positioned higher than the recessed portion 21*d* makes it easier to place the upstream portion in contact with the guide rail 22*a* when an operator lifts the grip 21 by grasping the grip 21, making it easier for the operator to lift the apparatus main assembly 20.

That is, the relationship between the grip 21 and guide rails 22*a* and 22*b*, in terms of their measurements, is as follows: FIGS. 5 and 6 show the relationship between the grip 21 and guide rails 22*a* and 22*b*. Part (a) of FIGS. 5-6(*b*) sequentially show the steps through which the protrusion 21*a* of the grip 21 slides over the protrusion 22*b*1 of the guide rail 22. Referring to FIGS. 5 and 6, in order to enable the protrusion 21*a* of the grip 21 to slide over the protrusion 22*b*1 of the guide rail 22, the grip 21 has to be pivoted about a pivot P, that is, the point of contact between the upstream end of the projection 22*b*2 of the guide rail 22 and the grip 21, in terms of the direction (indicated by arrow mark X) in which the grip 21 is moved from its innermost position to the outermost position, as the user lifts the grip 21 when the grip 21 is in the innermost position. If it is assumed here that the angle by which grip 21 pivotally move about the point P (pivot) of contact between the upstream end of the projection 22*b*2 of the guide rail 22, and the grip 21, is θ, and the distance between the recessed portion 21*d* and guide rail 22*a* when the grip 21 has not started pivoting (θ=0) is S. By the way, a state that the grip 21 has not started to pivotally move (θ=0) means that the grip 21 has not begun to be lifted by an operator, and is remaining supported by the guide rail 22*b*.

Further, it is assumed here that when the grip 21 is in the innermost position (grip 21 has not begun to be lifted), the length of the portion of the grip 21 from the pivot P to the point of contact between the protrusion 21*a* of the grip 21 and the protrusion 22*b*1 of the guide rail 22*b* is L0, and the length of the portion of the grip 21 from the pivot P to the point of contact between the protrusion 22*b*1 of the guide rail 22*b* and the protrusion 21*a* of the grip 21 is L1, in terms of the direction indicated by the arrow mark X, L1 is minutely longer than L0. Further, assuming that when the grip 21 is in its innermost position, the distance from point of contact between the protrusion 21*a* of the grip 21 and the protrusion 22*b*1 of the guide rail 22, to the end of the grip 21 in terms of the direction indicated by the arrow mark X is L2, when the grip 21 is in its innermost position, (L0+L2) equals the distance from the pivot P to the end of the grip 21. Here, "end of grip 21" means the downstream end of the grip 21 in terms of the direction in which the grip 21 is moved from the innermost position to the outermost position. Further, when the amount by which the most protrusive point of the protrusion 21*a* of the grip 21A is protrusive from the top surface of the grip 21A, that is, the height of the protrusion 21*a* of the grip 21 from the top surface of the grip 21A, in terms of the vertical direction (indicated by arrow mark Y) is H. By the way, the direction indicated by the arrow mark X is parallel to the direction in which the grip 21 is moved from its innermost position to its outermost position. It is parallel to the lengthwise direction of the grip 21. In this embodiment, it is parallel to the horizontal direction. The direction indicated by the arrow mark Y and the direction indicated by the arrow mark Y are perpendicular to each other.

In this embodiment, "L0 sin θ≥H1 cos θ" is satisfied. Thus, the height of the tip of the protrusion 21*a* of the grip 21A from the top surface of the grip 21 is the same as, or greater than, the height of the tip of the protrusion 22*b*1 of the guide rail 22*b*. Further, S≥(L0+L2) sine. Therefore, the protrusion 21*a* of the grip 21 is allowed to slide over the protrusion 22*b*1 of the guide rail 22, without being interfered by the guide rails 22*a* and 22*b*. Since the image forming apparatus A is structured so that its components described above satisfy the relationship among themselves in terms of their measurements, the grip 21 can be moved from its innermost position to its outermost position with no interference between the grip 21 and guide rails 22*a* and 22*b*.

The protrusion 21*a* of the grip 21 is provided with the surface 21*a*1 which is slanted relative to the moving direction (horizontal direction) of the grip 21. Thus, when the grip 21 is moved from its outermost position to its innermost position, this slanted surface 21*a*1 comes into contact with the protrusion 22*b*1 of the guide rail 22*b* before the tip of the protrusion 21*a* of the grip 21. Providing the grip 21 with the slanted surface 21*a*1 facilitates the protrusion 21*a* of the grip 21 to slides over the protrusion 22*b*1 of the guide rail 22*b*, facilitating thereby the movement of the grip 21 from its outermost position to its innermost position. By the way, this slanted surface 21*a*1 of the protrusion 21*a* of the grip 21 is such that unless a user intentionally applies force to the grip 21, the protrusion 21*a* of the grip 21 does not slide over the protrusion 22*b*1 of the guide rail 22*b*.

By the way, the upstream and downstream surfaces 21*a*1 and 21*a*2 of the protrusion 21*a* of the grip 21 in terms of the moving direction of the grip 21 may be slanted as shown in FIG. 7. With both the surfaces 21*a*1 and 21*a*2 being slanted, not only is it easier for an operator to move the grip 21 from its outermost position to its innermost position, but also, from the innermost position to the outermost position.

Further, when the grip 21 is in its outermost position, the protrusion 21*b* (other protrusion) of the grip 21, which is downwardly protrusive from the bottom surface of the metallic portion 21*x* is in engagement with the projection 22*b*2 (other protrusion) of the guide rail 22. Thus, there is the following relationship among the gap W1 between the top surface of the projection 22*b*2 of the guide rail 22*b* and guide rail 22*a*, gap W2 between the portion of the guide rail 22*a*, which does not have a projection, and the guide rail 22*b*, and dimension H2 of the protrusion 21*b* of the grip 21, in terms of the vertical direction, as shown in FIG. 4: W1≤H2≤W2. Therefore, when the grip 21 is moved from its innermost position to its outermost position, it can be moved until the protrusion 21*b* of the grip 21 comes into contact with the projection 22*b*2 of the guide rail 22, and also, engages with the projection 22*b*2 of the guide rail 22, as it comes into contact with the projection 22*b*2 of the guide rail 22*b*. With the image forming apparatus A being structured as described above, it is possible to prevent the problem that when the grip 21 is in its outermost position, it becomes disengaged from the guide rail 22, and drops out of the apparatus main assembly 20.

Further, image forming apparatus A is structured so that the portion of the grip 21, which remains in the apparatus main assembly 20 of the image forming apparatus A when the grip 21 is in its outermost position, is the metallic portion 21*x*. Therefore, it is possible for the grip 21 to bear the load to which the grip 21 is subjected as the image forming apparatus A is lifted, with the metallic portion 21*x*, which is highly rigid. Therefore, it is possible to reduce the grip 21 in size, and also, to prevent the grip 21 from being damaged.

Further, the protrusions 21*a* and 21*b* of the grip 21 are formed as parts of the resinous portion 21*y*. Therefore, they are afforded more latitude in terms of shape, making them easier to manufacture, and also, to provide them with nonslip surface.

By the way, in this embodiment, the image forming apparatus A was structured so that the protrusion 21*a* of the grip 21 engages with the protrusion 22*b*1 of the guide rail

22*b*. This embodiment, however, is not intended to limit the present invention in scope in terms of the structure of the image forming apparatus A. That is, the present invention is also applicable to an image forming apparatus structured so that the grip 21 or guide rail 22 is provided with a projection, and the other is provided with a recessed portion, and the projection fits into the recessed portion. The application of the present invention to such an image forming apparatus can provides the same effect as those described above.

Further, in this embodiment, the protrusion 21*a* of the grip 21 is provided with the slanted surfaces 21*a*1 and 21*a*2. This embodiment, however, is not intended to limit the present invention in scope in terms of the structure of an image forming apparatus. That is, the present invention is also applicable to an image forming apparatus structured so that the protrusion 22*b*1 of the guide rail 22 is provided with a slanted surface which is similar to the ones described above.

Also in this embodiment, the image forming apparatus A was provided with two grips 21. However, this embodiment is not intended to limit the present invention in scope. That is, the present invention is also applicable to an image forming apparatus structured so that it is not only the right side, but also, the left side, of the apparatus main assembly 20, that is provided with the grips 21. With both sides of the image forming apparatus being provided with the grips 21, two or more operators can lift the image forming apparatus together, and therefore, the image forming apparatus remains more stable in attitude than in a case where only one side of an image forming apparatus is provided with the grips 21. Moreover, the present invention is also applicable to an image forming apparatus structured so that the apparatus main assembly 20 is provided with only one grip 21, and the portion of the apparatus main assembly 20 other than the portion having the protrusion 21*a* is provided with a recessed portion, into which an operator can put his or her finger to hook the apparatus main assembly 20 to lift the apparatus main assembly 20.

Further, in this embodiment, the image forming apparatus A was an electrophotographic image forming apparatus. This embodiment, however, is not intended to limit the present invention in the type of an image forming apparatus. For example, the present invention is also applicable to an image forming apparatus of the ink-jet type, which forms an image on a sheet of recording medium by ejecting ink onto a sheet of recording medium from its nozzles, for example.

According to the present invention, it is possible to prevent the problem that the grip of an image forming apparatus accidentally moves from its innermost position to its outermost position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-025102 filed on Feb. 15, 2019, which is hereby incorporated by reference herein in its entirety.

What is claimed is:

1. An image forming apparatus comprising:

an image forming unit configured to form an image on a sheet;

a main assembly configured to accommodate said image forming unit on an inside thereof;

a grip unit linearly movable between a first position accommodated inside said main assembly and a second position projecting from said main assembly, said grip unit configured to move in a moving direction to move from the first position to the second position, said grip unit including:

(a) a grip portion protruding toward an outside of said main assembly and configured to be grasped by a user to lift said main assembly in a state in which said grip unit is positioned at the second position; and (b) a resinous portion formed of a resin, said resinous portion being provided on a downstream side of said grip portion with respect to the moving direction, said resinous portion having:

(i) an exposure portion exposed to an outside of said main assembly in a state in which said grip unit positioned at the first position; and (ii) a projection provided on an upstream side of said exposure portion with respect to the moving direction of said grip unit, said projection projecting downwardly from a bottom surface of said grip unit;

a first guiding member provided above said grip unit and configured to guide the movement of said grip unit; and a second guiding member provided below said grip unit and configured to guide the movement of said grip unit together with said first guiding member, said second guiding member having an engaging portion projecting from an upper surface of said second guiding member and capable of engaging with said projection to restrict movement of said grip unit toward the second position when said grip unit is in the first position.

2. The image forming apparatus according to claim 1, wherein a surface of said grip portion opposing said first guiding member is provided with a recess recessing at a predetermined position toward a downstream side with respect to the moving direction.

3. The image forming apparatus according to claim 1, wherein said grip unit has an additional projection projecting downwardly from the bottom surface of said grip unit at a position upstream of said projection with respect to the moving direction, and wherein said second guiding member is provided with an additional engaging portion capable of engaging with said additional projection to prevent said grip portion from disengaging from said second guiding member when said grip portion is in the second position, said additional engaging portion being on an upstream side of said engaging portion with respect to the moving direction.

4. The image forming apparatus according to claim 1, wherein said projection of said resinous portion is provided with an inclined surface inclined relative to the moving direction.

5. The image forming apparatus according to claim 1, wherein at least a part of said grip portion which is inside said main assembly when said grip portion is in the second position is made of metal.

6. The image forming apparatus according to claim 1, wherein said exposure portion is configured to be operated by the user while said grip unit is drawn out from the first position to the second position, and wherein said exposure portion and said projection are integrally formed of the resin.

7. The image forming apparatus according to claim 1, further comprising:

an accommodating portion below said image forming unit and configured to accommodate the sheet in a vertical direction; and a sheet passage configured to convey the sheet accommodated in said accommodating portion to said image forming unit, wherein said grip unit is provided on the front side of said sheet passage with respect to a front-rear direction of said image forming apparatus.

8. The image forming apparatus according to claim 7, further comprising another grip unit movable between an accommodating position where said another grip unit is accommodated inside of said main assembly and a protrusion position where said another grip unit protrudes to the outside of said main assembly, said another grip unit provided on the back side of said sheet passage with respect to the front-rear direction.

9. An image forming apparatus comprising:

an image forming unit configured to form an image on a sheet;

a main assembly configured to accommodate said image forming unit on inside thereof;

a grip unit linearly movable between a first position accommodated inside said main assembly and a second position projecting from said main assembly, said grip unit being configured to be grasped by a user to lift said main assembly in a state in which said grip unit is positioned at the second position, said grip unit includes a projection projecting downwardly from a lower surface of said grip unit;

a first guiding member provided above said grip unit and configured to guide the movement of said grip unit; and a second guiding member provided below said grip unit and configured to guide the movement of said grip unit together with said first guiding member, said second guiding member having an engaging portion projecting from an upper surface of said second guiding member and capable of engaging with said projection to restrict movement of said grip unit toward the second position when said grip unit is in the first position.

10. The image forming apparatus according to claim 9, wherein said grip unit is configured to move in a moving direction to move from the first position to the second position, said grip unit including:

(a) a resinous portion formed of a resin, said resinous portion having (i) an exposure portion exposed to an outside of said main assembly in a state in which said grip unit positioned at the first position and (ii) the projection provided on an upstream side of said exposure portion with respect to the moving direction of said grip unit; and (b) a metal portion formed of a metal, said metal portion accommodated inside said main assembly in a state in which said grip unit positioned at the first position and protruding to an outside of said main assembly and configured to be grasped by a user in a state in which said grip unit is positioned at the second position.

11. The image forming apparatus according to claim 10, wherein said exposure portion is configured to be operated by the user while said grip unit is drawn out from the first position to the second position, and wherein said exposure portion and said projection are integrally formed of the resin.

12. The image forming apparatus according to claim 9, wherein a surface of said grip unit-opposing said first guiding member is provided with a recess recessing at a predetermined position toward a downstream side with respect to the moving direction.

13. The image forming apparatus according to claim 9, wherein said grip unit has an additional projection projecting downwardly from the bottom surface of said grip unit at a position upstream of said projection with respect to the moving direction, and wherein said second guiding member is provided with an additional engaging portion capable of engaging with said additional projection to prevent said grip portion from disengaging from said second guiding member when said grip portion is in the second position, said additional engaging portion being on an upstream side of said engaging portion with respect to the moving direction.

14. The image forming apparatus according to claim 9, wherein said projection of said grip unit has an inclined surface inclined relative to the moving direction of said grip unit.

15. The image forming apparatus according to claim 9, wherein at least a part of said grip unit which is inside said main assembly when said grip portion is in the second position is made of metal.

16. The image forming apparatus according to claim 9, further comprising:

an accommodating portion below said image forming unit and configured to accommodate the sheet in a vertical direction; and a sheet passage configured to convey the sheet accommodated in said accommodating portion to said image forming unit, wherein said grip unit is provided on the front side of said sheet passage with respect to a front-rear direction of said image forming apparatus.

17. The image forming apparatus according to claim 16, further comprising another grip unit movable between an accommodating position where said another grip is accommodated inside of said main assembly and a protrusion position where said another grip protrudes to the outside of said main assembly, said another grip unit provided on the back side of said sheep passage with respect to the front-rear direction.

* * * * *